US005587063A

United States Patent [19]

Kuhm et al.

[11] Patent Number: 5,587,063

[45] Date of Patent: Dec. 24, 1996

[54] METHOD FOR ELECTROLYTIC COLORING OF ALUMINUM SURFACES USING ALTERNATING CURRENT

[75] Inventors: Peter Kuhm, Hilden; Christine Schroeder, Duesseldorf; Volker Sander, Hilden; Juergen Lindener; Loert De Riese-Meyer, both of Duesseldorf, all of Germany

[73] Assignee: Henkel Kommanditgesellschaft auf Aktien, Duesseldorf, Germany

[21] Appl. No.: 464,702

[22] PCT Filed: Dec. 16, 1993

[86] PCT No.: PCT/EP93/03574

§ 371 Date: Jul. 28, 1995

§ 102(e) Date: Jul. 28, 1995

[87] PCT Pub. No.: WO94/15002

PCT Pub. Date: Jul. 7, 1994

[30] Foreign Application Priority Data

Dec. 24, 1993 [DE] Germany ..... 42 44 021.1

[51] Int. Cl.[6] ..... C25D 11/22

[52] U.S. Cl. ..... 205/173; 205/174

[58] Field of Search ..... 205/105, 173, 205/174

[56] References Cited

U.S. PATENT DOCUMENTS

| | | | |
|---|---|---|---|
| 3,787,295 | 1/1974 | Endihger et al. | 205/173 |
| 3,935,084 | 6/1976 | Terai et al. | 204/58 |
| 4,070,255 | 1/1978 | Hasegawa et al. | 205/105 |
| 4,917,780 | 4/1990 | Brodalla et al. | 204/37.6 |
| 5,064,512 | 11/1991 | Brodalla et al. | 204/37.6 |

FOREIGN PATENT DOCUMENTS

| | | |
|---|---|---|
| 0354365 | 2/1990 | European Pat. Off. . |
| 2085799 | 12/1971 | France . |
| 2384037 | 3/1977 | France . |
| 0741743 | 11/1943 | Germany . |
| 2144969 | 9/1971 | Germany . |
| 2428635 | 1/1975 | Germany . |
| 2450175 | 5/1975 | Germany . |
| 3246704 | 7/1983 | Germany . |
| 4034304 | 4/1992 | Germany . |
| 46-020568 | 6/1971 | Japan . |
| 53-116348 | 10/1978 | Japan . |
| 54-031045 | of 1979 | Japan . |
| 54-116349 | 9/1979 | Japan . |
| 56-116899 | 9/1981 | Japan . |
| 57-200221 | 12/1982 | Japan . |
| 58-113391 | 7/1983 | Japan . |
| 1482390 | 8/1977 | United Kingdom . |

OTHER PUBLICATIONS

S. A. Pozzoli, F. Tegiacchi; Korros. Korrosionsschutz Alum., Veranst. Eur. Foed. Korros. Vortr. 88th 1976, 139–45 month of publication not available.

E. P. Short et al., Paper 830389 S.A.E. Conference, Feb. 1983, Detroit, USA.

*Primary Examiner*—Bruce F. Bell
*Assistant Examiner*—William T. Leader
*Attorney, Agent, or Firm*—Ernest G. Szoke; Wayne C. Jaeschke; Norvell E. Wisdom, Jr.

[57] ABSTRACT

Anodized aluminum surfaces are electrolytically colored using alternating current in a process in which two different coloring baths are sequentially employed. One bath contains copper(II) ions and an additive which improves throwing power thereby providing uniform distribution of the depth of color. The other bath contains tin(II) ions, silver ions, or both tin(II) and silver ions. If tin(II) ions are included, additives which stabilize tin(II) ions and improve throwing power are also included. Either bath may be used first. The use of two separate coloring baths provides colored aluminum surfaces which have excellent resistance to corrosion. Workpieces with reddish-gold hues and darker tones can be produced.

20 Claims, No Drawings

METHOD FOR ELECTROLYTIC COLORING OF ALUMINUM SURFACES USING ALTERNATING CURRENT

FIELD OF THE INVENTION

This invention relates to a new process for the electrolytic alternating-current coloring of anodized aluminum surfaces in acidic coloring baths containing copper(II) ions, optionally in conjunction with other acidic coloring baths containing Sn(II) ions and/or silver ions, more particularly for the production of reddish gold tones ranging from champagne through gold to bronze tones.

STATEMENT OF RELATED ART

It is known that, on account of its base character, aluminum becomes covered with a natural oxide coating generally below 0.1 μm in thickness (Wernick, Pinner, Zurbrügg, Weiner; *Die Oberflächenbehandlung von Aluminum* [Title in English: The Surface Treatment of Aluminum], 2nd Edition (Eugen Leuze Verlag, Saulgau/Württ., 1977).

Considerably thicker oxide coatings can be obtained by electrolytic oxidation of aluminum. This process is known as anodizing. Sulfuric acid, chromic acid or phosphoric acid is preferably used as the electrolyte. Organic acids, such as for example oxalic acid, maleic acid, phthalic acid, salicylic acid, sulfosalicylic acid, sulfophthalic acid, tartaric acid or citric acid, are also used in some processes.

However, sulfuric acid is the most commonly used electrolyte. Depending on the anodizing conditions, layer thicknesses of up to 150 μm can be obtained in this process. However, layer thicknesses of 20 to 25 μm are sufficient for external applications, such as for example facade facings or window frames.

The anodizing process is generally carried out in 10 to 20% sulfuric acid with a current density of 1.5 A/dm$^2$, at a temperature of 18° to 22 ° C. and over a period of 15 to 60 minutes, depending on the required layer thickness and the particular application.

The oxide coatings thus produced have a high absorption capacity for a number of organic and inorganic substances or dyes.

Electrolytic coloring processes, in which anodized aluminum is colored by treatment with alternating current in heavy metal salt solutions, have been known since the middle of the thirties. The heavy metals used are, above all, elements of the first transition series, such as Cr, Mn, Fe, Co, Ni, Cu and, in particular, Sn. The heavy metal salts are generally used as sulfates, a pH value of 0.1 to 2.0 being adjusted with sulfuric acid. The coloring process is carried out at a voltage of around 10 to 25 V and at the resulting current density. The counter-electrode may either consist of graphite or stainless steel or of the same material which is dissolved in the electrolyte.

In this process, the heavy metal pigment is deposited in the pores of the anodic oxide coating in the half cycle of the alternating current in which aluminum is the cathode, the aluminum oxide coating being further thickened by anodic oxidation in the second half cycle. The heavy metal is deposited at the bottom of the pores and thus colors the oxide coating.

However, one of the problems encountered where coloring is carried out with tin electrolytes is that the tin readily oxidizes so that basic tin(IV) oxide hydrates (stannic acid) are rapidly precipitated during the application and, in some cases, even during the storage of the Sn solutions. It is known that aqueous tin(II) sulfate solutions are oxidized to tin(IV) compounds simply by exposure to atmospheric oxygen or by reaction at the electrodes in the presence of current. This is highly undesirable in the coloring of anodized aluminum in tin electrolytes because, on the one hand, it disrupts the process sequence (frequent renewal or topping up of the solutions rendered unusable by the formation of precipitates) and, on the other hand, leads to considerable extra costs because of the tin(IV) compounds which cannot be used for coloring. Accordingly, various processes have been developed, differing in particular in the means used to stabilize the generally sulfuric acid tin(II) sulfate solutions for the electrolytic coloring of aluminum.

Phenol-like compounds, such as phenol sulfonic acid, cresol sulfonic acid or sulfosalicylic acid, are by far the most commonly used (S. A. Pozzoli, F. Tegiacchi; "Korros. Korrosionsschutz Alum.", *Veranst. Eur. Foed. Korros. Vortr.* 88th 1976, 139–45). Polyhydric phenols such as, for example, the diphenols hydroquinone, pyrocatechol and resorcinol (JP-A-58 113391, 57 200221; FR-A-23 84 037) and the triphenols phloroglucinol (JP-A-58 113391) and pyrogallol (S. A. Pozzoli, F. Tegiacchi; "Korros. Korrosionsschutz Alum.", *Veranst. Eur. Foed Korros., Vortr.* 88th 1976, 139–45; JP-A-58 113391; 57 200221) have also been described in this connection.

Another significant problem in electrolytic coloring is so-called throwing power (depth throwing) which is understood to be the ability of a product to color anodized aluminum parts situated at different distances from the counter-electrode with a uniform color. Good throwing power is particularly important when the aluminum parts used are complicated in shape (coloring of depressions), when the aluminum parts are very large and when, for economic reasons, several aluminum pans have to be simultaneously colored in a single coloring process and medium color tones are to be obtained. In practice, therefore, high throwing power is highly desirable because faulty production is avoided and the optical quality of the colored aluminum pans is generally better. The process is made more economical by good throwing power because several pans can be colored in a single operation.

Throwing power is not the same as uniformity and a clear distinction has to be drawn between the two. Uniformity applies to coloring with minimal local variations in color (patchy coloring). Poor uniformity is generally caused by impurities, such as nitrate, or by errors in the anodizing process. A good coloring electrolyte should not impair the uniformity of coloring under any circumstances.

Although a coloring process may achieve high uniformity, it may still have poor throwing power; the reverse is also possible. In general, uniformity is only influenced by the chemical composition of the electrolyte while throwing power is also dependent upon electrical and geometric parameters, such as for example the shape of the workpiece or its positioning and size.

DE-A-24 28 635 describes the use of a combination of tin(II) salts and zinc salts with addition of sulfuric acid and boric acid and also aromatic carboxylic and sulfonic acids (sulfophthalic acid or sulfosalicylic acid) in the electrolytic coloring of anodically oxidized articles of aluminum in grey tones. Good throwing power is said to be obtained in particular when the pH value is between 1 and 1.5. pH adjustment to 1–1.5 is a basic prerequisite for good electrolytic coloring. There is no mention of whether the organic acids added have an effect on throwing power, nor is the throwing power achieved quantitatively described.

DE-A-32 46 704 describes a process for electrolytic coloring in which good throwing power is guaranteed by the use of special geometry in the coloring bath. In addition, cresol and phenol sulfonic acid, organic substances, such as dextrin and/or thiourea and/or gelatine, are said to guarantee uniform coloring. The disadvantage of this process lies in the high capital investment in the installation of the necessary machinery. The addition of deposition inhibitors, such as dextrin, thiourea and gelatine, has only a slight influence on throwing power because the deposition process in electrolytic coloring differs considerably from that involved in electroplating with tin. There is also no indication in this document of how the improvements in throwing power can be measured.

In addition, European patent application EP-A-354 365 describes a process for the electrolytic metal salt coloring of anodized aluminum surfaces in which antioxidants corresponding to a general formula (of the claims) are used together with the throw improvers p-toluene sulfonic acid and/or naphthalene sulfonic acid.

However, certain reddish color tones cannot be obtained by using tin(II)-containing coloring baths alone so that other heavy metal ions have also been used for some time to obtain such color tones. For example, alternating-current coloring with coloring baths containing silver ions for the production of reddish brown decorative color tones is known, for example, from DE-A-38 24 402. These color tones are obtained by the use of p-toluene sulfonic acid in the coloring baths. Although this compound is known as a throw improver from coloring with tin(II) ions, it is used for the production of light-stable gold tones with no visible green tinge in coloring with silver ions. Coloring baths containing silver ions normally do not require a throw improver because the throwing properties of these baths are satisfactory.

Electrolytic alternating-current coloring with copper-containing electrolytes is known from DE-C-741 743. Although anodized aluminum panels colored by electrolytic alternating-current coloring with copper-containing electrolytes has been used for house facades since the early sixties, particularly in Japan, the color tones to be obtained are difficult to reproduce consistently (Wernick et al., loc. cit.). Dark color tones produced by this process show signs of surface bloom after only brief exposure to bright light and, accordingly, are not light-stable and hence cannot be used for architectural applications (E. P. Short et al., Paper 830389 S.A.E. Conference, February 1983, Detroit, USA and Wernick et al., loc. cit.). On account of the poor corrosion resistance of aluminum surfaces electrolytically a.c.-colored with copper electrolytes, they were excluded from the Qualanod quality index "Specifications for the Quality Sign of Anodic Oxidation Coatings on Wrought Aluminum for Architectural Purposes" Zurich 1983. The disadvantages of known copper-based colors in relation to nickel- and cobalt-based colors in the salt spray test are also mentioned by Short et al., loc. cit.

There has been a demand, particularly recently, for reddish gold and bronze tones for architectural applications. JP-B-71 020 568 describes an electrolyte solution containing tin(II) sulfate, cresol sulfonic acids or phenol sulfonic acids, sulfuric acid and, alternatively, a sulfate of nickel, cobalt, cadmium, zinc, potassium, chromium, iron, zirconium, manganese, magnesium, lead or copper in a coloring bath.

An electrolyte containing tin and copper is also known from GB-A-1,482,390. Unfortunately, the surfaces thus obtained show relatively poor corrosion resistance.

According to DE-B-24 50 175, aminoalcohols, particularly alkanolamines, are added to the silver coloring electrolyte to ensure uniform coloring of the aluminum oxide coating in relatively short coloring times.

Single-stage coloring processes which use an electrolyte containing both silver and copper ions and which leave reddish color tones on anodized aluminum surfaces are widely documented in the prior art literature. Thus, JP-A-54 031 045 describes a weakly alkaline electrolyte which, in addition to silver and copper salts, contains amines, ammonia or salts thereof besides organic acids. The amines serve as ligands for the formation of complexes of the two heavy metals.

JP-A-56 116 899 describes a process for coloring anodized aluminum surfaces with an electrolyte containing silver and optionally copper ions. This process is characterized in that, after the electrolytic coloring step, the surface is aftertreated with an aqueous solution or suspension containing at least one thiocarboxylic acid amide. This aftertreatment is intended to prevent decoloring of the substrates under the effect of light.

DE-C-21 44 969 describes a process for the electrochemical alternating-current coloring of anodized aluminum in acidic solution using an electrolyte containing copper ions in addition to silver ions. A particular feature of this process is that the aluminum oxide coating is colored with a color tone which is darker than required. Accordingly, direct-current electrolysis (with the article to be colored acting as anode) is carried out as a further process step until the required color tone is achieved through lightening.

JP-A-53 116 348 and JP-A-54 116 349 describe processes for the alternating-current coloring of anodized aluminum surfaces in which reddish to black color tones are obtained. According to these documents, coloring is first carried out in a sulfuric acid or phosphoric acid electrolyte which, in addition, contains an ion of a metal more noble than hydrogen (silver, copper) and also a magnesium salt, boric acid or an aluminum salt as corrosion inhibitor. Coloring is carried out at an a.c. voltage of 2 to 18 V. A second alternating-current treatment is then carried out in an electrolyte containing nickel, cobalt or tin ions. The same corrosion inhibitor as described above is again used. In addition, this bath contains oxalic acid, citric acid, tartaric acid, ammonia and/or amines.

Unfortunately, the process described in these documents suffers considerable losses of tin through oxidation to tin(IV) compounds. In addition, thin white coatings which impair the quality of coloring can remain on the colored workpieces. Moreover, the depth of color on the colored surfaces is uneven in the sense of relatively poor throwing. With typical workpieces, the depth of color in a few places is less than half the value in the most heavily colored area. Accordingly, these workpieces are unsuitable for architectural applications and for decorative applications.

DESCRIPTION OF THE INVENTION

Object of the Invention

Accordingly, the main problem addressed by the present invention was to provide a process for the electrolytic alternating-current coloring of anodized aluminum surfaces in which reddish gold tones in particular could be obtained. Another main problem addressed by the present invention was to provide colored aluminum surfaces which would have an extremely uniform distribution of the depth of color over the entire surface, even in the case of workpieces of complicated shape.

Another problem addressed by the present invention was to provide corresponding colored aluminum surfaces which, in addition, would meet particular corrosion protection requirements.

SUMMARY OF THE INVENTION

In a first embodiment of the present invention, the main problems stated above are solved by colored aluminum surfaces with reddish gold tones and good depth throwing produced by a process for the electrolytic alternating-current coloring of anodized aluminum surfaces in acidic coloring baths containing copper(II) ions which is characterized by the use of an electrolyte additive A selected from (a) benzene sulfonates corresponding to general formula (I):

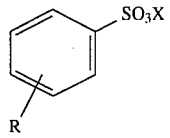

(I)

in which

R stands for one or more position-isomeric moieties and represents hydrogen, hydroxyl, carboxyl or aldehyde, with the proviso that no more than one carboxylic group (COOX) is attached to the benzene ring, and X represents hydrogen or an alkali metal cation selected from sodium or potassium, and (b) naphthalene disulfonates corresponding to general formula (II):

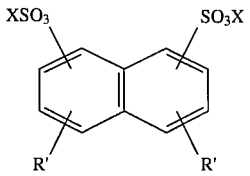

(II)

in which

R' stands for one or more position-isomeric moieties and represents hydrogen, hydroxyl, carboxyl or aldehyde, with the proviso that no hydroxy group is present in the 1-position of the naphthalene ring, and X is as defined above.

It is possible by the process mentioned above to color anodized aluminum surfaces with copper ions and to obtain an extremely uniform distribution of the depth of color (depth throwing). As expected, the corrosion resistance of the layers thus obtained could not be significantly improved in relation to the cited prior art concerned with coloring using copper(II) ions alone.

Whereas a large number of throw improvers for coloring with coloring baths containing tin(II) ions is known from the prior art, for example from EP-A-354 365 and DE-A-40 34 304, it has been found in accordance with the present invention that only selected throw improvers can be used for the electrolytic alternating-current coloring of anodized aluminum surfaces in coloring baths containing copper(II) ions, other throw improvers leading to very light layers or even to decoloring, i.e. non-coloring Thus, it has surprisingly been found that the particularly preferred throw improvers for tin-containing coloring baths, such as benzene hexacarboxylic acid or 4-sulfophthalic acid, cannot be used without disadvantages in coloring baths containing copper(II) ions.

DESCRIPTION OF PREFERRED EMBODIMENTS

To obtain reproducible surface coatings, it is of course necessary to keep the concentration of copper(II) ions in the coloring bath constant. Accordingly, a particularly preferred embodiment of the present invention is characterized in that the coloring bath contains 1 to 3 g/l and, more particularly, 1 to 2 g/l of copper(II) ions. An extremely attractive intensity of color can be established within this range. Any increase in the copper content beyond the limits mentioned on the one hand leads to economic disadvantages. On the other hand, the color finishes become uneven and difficult to reproduce. If the copper(II) ions are used in concentrations below the limits mentioned above, the coloring times have to be increased accordingly to obtain an intensive depth of color which, in turn, is an economic disadvantage.

Although the method by which the copper(II) ions are introduced into the coloring baths to be used is of minor importance, it is nevertheless preferred to introduce copper(II) ions into the coloring baths in the form of copper(II) sulfate. This method of introduction is of particular advantage when the electrolyte consists of sulfuric acid so that, in this case, no other—possibly troublesome—anions are introduced into the coloring baths.

In the course of the extensive investigations into the effect of the throw improvers in coloring baths containing copper(II) ions, it was found that only selected throw improvers produce particularly good results. In one particularly preferred embodiment of the present invention, therefore, the electrolyte additive A is selected from 2-sulfobenzoic acid, sulfosalicylic acid, 2-naphthol-3,6-disulfonic acid and mixtures thereof. The corresponding sodium and/or potassium salts may of course also be used in this embodiment, the sodium salts being preferred. Particularly uniform depth of color was obtained with these compounds, even in workpieces of complicated geometry.

The quantity of electrolyte additive A to be used essentially corresponds to the quantity known from coloring with tin. Accordingly, a preferred embodiment of the present invention is characterized in that the electrolyte additive A is used in a quantity of 2 to 30 g/l and, more particularly, in a quantity of 5 to 20 g/l, based on the coloring bath.

As mentioned above, various ways of preparing acidic electrolytes are known to one skilled in the art. It is particularly preferred to use an electrolyte containing sulfuric acid, more particularly in a quantity of 2 to 25 g/l.

Coloring is normally carried out with an acidic copper(II) sulfate solution at a pH value of 0.5 to 2, corresponding to 16 to 22 g of sulfuric acid per liter, and at a temperature of 10° to 30 ° C. The a.c. voltage or the a.c. voltage superimposed on direct current (50 to 60 Hz) is preferably adjusted at a terminal voltage of 10 to 25 V and preferably 15 to 18 V with an optimum of around 17 V±1 V.

In the context of the invention, alternating-current coloring is either understood to be coloring with pure alternating current or coloring with "alternating current superimposed in direct current" or "direct current superimposed on alternating current". Coloring begins at a current density—resulting from the voltage—of mostly around 1 A/dm$^2$ which, thereafter, generally falls to a constant value of 0.2 to 0.5 A/dm$^2$. Different color tones are obtained according to the voltage, the concentration of metal in the coloring bath and the immersion times.

Another embodiment of the present invention for solving all the problems stated above is characterized by a process in which aluminum surfaces are electrolytically colored with alternating current in another process step using acidic coloring baths containing tin(II) ions and/or silver ions.

This embodiment is characterized, for example by the use in known manner of acidic coloring baths containing tin(II) ions, stabilizers for tin(II) ions (antioxidants) and throw improvers in the form of an electrolyte additive B.

The electrolyte additive B for an acidic, tin(II)-containing coloring bath for the alternating-current coloring of anodized aluminum surfaces is characterized in that it contains stabilizers for tin(II) ions corresponding to general formulas (III) to (VII):

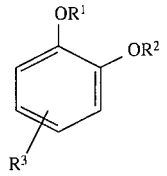

(III)

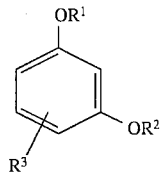

(IV)

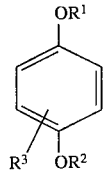

(V)

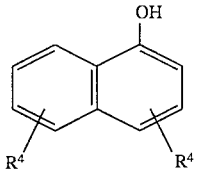

(VI)

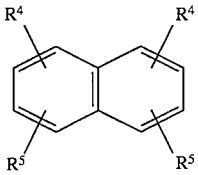

(VII)

in which $R^1$ and $R^2$ represent hydrogen, alkyl, aryl, alkylaryl, alkylaryl sulfonic acid, alkyl sulfonic acid and alkali metal salts thereof containing 1 to 22 carbon atoms, $R^3$ represents one or more hydrogen and/or alkyl, aryl, alkylaryl moieties containing 1 to 22 carbon atoms, $R^4$ represents one or more sulfonic acid groups ($SO_3X$), $R^5$ represents one or more hydrogen and/or alkyl, aryl, alkylaryl moieties containing 1 to 22 carbon atoms and X is as defined above, at least one of the substituents $R^1$, $R^2$ and $R^3$ not being hydrogen, and throw improvers corresponding to general formulae (VIII) and/or (IX):

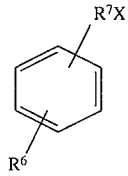

(VIII)

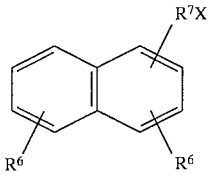

(IX)

in which $R^6$ stands for one or more position-isomeric moieties and represents hydrogen, hydroxyl, carboxyl, aldehyde and $C_{1-6}$ alkyl, $R^7$ represents one or more carboxylate groups (COO) or sulfonic acid groups ($SO_3X$) and X is hydrogen or an alkali metal cation selected from sodium and/or potassium.

Coloring baths containing only silver ions do not generally require any throw improvers or stabilizers for silver ions.

A major advantage of the electrolyte additive B according to the invention both on its own and in conjunction with the coloring bath containing copper(II) ions lies in the use of oxidation-stable, water-soluble throw improvers in coloring baths containing tin(II) ions. According to the invention, therefore, it is particularly important to provide the throw improvers with oxidation-stable functional groups, such as carboxyl, hydroxyl and/or sulfonic acid groups. In addition, the functional groups mentioned guarantee the necessary solubility in water.

It is possible in accordance with the present invention through the use of different coloring baths containing on the one hand copper(II) ions and, on the other hand, tin(II) ions and/or silver ions to obtain intensive, highly uniform depths of color providing the coloring bath containing copper(II) ions is provided with special throw improvers and, in addition, the coloring bath containing tin(II) ions also contains stabilizers for tin(II) ions and throw improvers.

According to the invention, therefore, it is preferred to carry out coloring with a tin(II)-containing solution which preferably contains 3 to 30 g/l and, more preferably, 7 to 16 g/l of tin(II) ions. The tin(II) ions are preferably introduced into the coloring baths in the form of tin(II) sulfate.

According to the invention, 2-tert.butyl-1,4-dihydroxybenzene (tert.butyl hydroquinone), methyl hydroquinone, trimethyl hydroquinone, 4-hydroxy-2,7-naphthalene disulfonic acid, naphthalene-1,5-disulfonic acid and/or p-hydroxyanisole in particular are used in the above-mentioned concentrations as the stabilizers for tin(II) ions corresponding to general formulas (III) to (VII). In one preferred embodiment of the present invention, the coloring bath contains at least one of the compounds corresponding to one of general formulae (III) to (VII) in a quantity of 0.01 to 2 g/l as stabilizer for tin(II) ions.

According to the invention, 5-sulfosalicylic acid, 4-sulfophthalic acid, 2-sulfobenzoic acid, benzoic acid, sulfoterephthalic acid, naphthalene trisulfonic acid, 1-naphthol-2, 3-sulfonic acid, naphthalene sulfonic acid, p-toluene sulfonic acid and/or benzene hexacarboxylic acid in particular are used as the throw improvers corresponding to general formulas (VIII) and/or (IX). It has proved to be particularly effective by virtue of a synergistic effect to use 5-sulfosalicylic acid and 4-sulfophthalic acid in conjunction with one another. The sodium salts of the acids mentioned are preferably used. In one preferred embodiment of the present invention, the coloring bath also contains throw improvers in a quantity of 0.1 to 30 g/l.

Another preferred embodiment of the present invention is characterized in that the substantially copper-free coloring bath contains silver ions. Whereas it was necessary in the prior art to introduce organic agents into the coloring bath to avoid green tinges in the silver color, it is possible by virtue of the present invention to produce reddish gold tones using coloring baths containing silver ions which manage without the use of organic additives. It is known that there is no need to use throw improvers where coloring is carried out with silver ions because satisfactory throwing power is obtained in this case. However, if tin(II) ions are simultaneously present in the coloring bath, it is generally necessary to use the throw improvers mentioned above to obtain a uniform surface.

In another embodiment of the present invention, the electrolyte solution contains 0.1 to 10 g/l and preferably 0.3 to 1.2 g/l of silver in the form of water-soluble salts, for example in the form of nitrates, acetates and/or sulfates, the use of silver sulfate being particularly preferred.

Although, according to the invention, there is generally no need to use organic additives where coloring is carried out with coloring baths containing silver ions, it is possible in this case, too, to use additives known from the prior art. In contrast to the prior art, however, these additives are not absolutely essential for obtaining the reddish gold tones. For example, the coloring bath may contain p-toluene sulfonic acid and/or water-soluble alkali metal, ammonium and/or alkaline earth metal salts thereof, more particularly in a quantity of 3 to 100 g/l and preferably in a quantity of 5 to 25 g/l of electrolyte solution.

Although many other acidic electrolytes are known to one skilled in the art in the field in question, it is particularly preferred for the purposes of the present invention to use a sulfuric acid electrolyte which contains the sulfuric acid in a quantity of, in particular, 2.5 to 100 g/l and preferably 5 to 30 g/l.

Coloring is preferably carried out with a coloring bath containing tin(II) ions and/or silver ions at a pH value of 0.1 to 2.0, corresponding to 16 to 22 g of sulfuric acid per liter, and at a temperature of around 10° to 30° C. The a.c. voltage or a.c. voltage superimposed on direct current (50 to 60 Hz) is preferably adjusted at a terminal voltage of 4 to 25 V, more particularly 8 to 18 V and, more preferably, 15 to 18 V with an optimum of around 17 V±1 V.

When the coloring bath containing copper(II) ions is separate from the coloring bath containing tin(II) ions and/or silver ions in accordance with the invention, it is clear from this that the two process steps are separated in time. To this end, the coloring bath containing tin(II) ions and/or silver ions should not contain any significant quantities of copper(II) ions and, conversely, the coloring bath containing copper(II) ions should not contain any significant quantities of tin(II) ions and/or silver ions.

In a first embodiment of the present invention, therefore, the process is characterized in that the anodized aluminum surfaces are colored first with the coloring baths containing copper(II) ions and then with the coloring bath containing tin(II) ions and/or silver ions.

In another embodiment of the invention, therefore, the process is characterized in that the anodized aluminum surfaces are colored first with the coloring bath containing tin(II) ions and/or silver ions and then with the coloring baths containing copper(II) ions. In extensive tests, it was found that the order in which the two coloring steps are carried out is evidently not important to the uniformity factor in the sense of good depth throwing and intensity of the depth of color.

It has been found that it is possible by the process according to the invention to obtain particularly intensive, visually attractive reddish gold tones ranging from champagne to bronze or brown tones on anodized aluminum surfaces which are far superior in regard to corrosion resistance to known processes which use the same metal cations simultaneously in the coloring baths.

The invention is illustrated by the Examples.

EXAMPLES

Test methods

Evaluation of throwing power in coloring baths containing copper(II) ions

Test plates measuring 50 mm×460 mm×1 mm of the DIN material Al 99.5 were conventionally pretreated and then electrolytically colored in a coloring bath of suitable geometry (electrode at a distance of 1 to 5 cm from the counter-electrodes). In addition to 2 g/l Cu ions ($CuSO_4 \cdot 5H_2O$) and 8 g/l of sulfuric acid, the coloring bath contained various quantities of test substances (see Examples and Comparison Examples). Coloring was carried out for 90 seconds at a voltage of 17.5 V (alternating current 50 Hz).

The coloring result was numerically determined as follows: first the distribution of copper on the test plate was determined at 10 different places in the longitudinal direction (i.e. every 5 cm) by measurement with a scattered-light reflectometer against the white standard titanium dioxide (=99%). The "average coloring" is calculated from the individual measurements. Throwing power is determined therefrom as a measure of the accordance of each point of measurement with the average value and is expressed as a percentage. A throwing power of 100% means that the test plate is uniformly colored over its entire length. The nearer the values come to 0%, the more differently the plate ends are colored.

The Examples and Comparison Examples are summarized in Table 1 below. The intensity of color of the plates was compared with that of Comparison Example 1. The observation "lighter" signifies a lower intensity of color in relation to Comparison Example 1. By contrast, the observation "decolored" means that decoloring of the layer occurred. Whereas an excessively light color can generally be improved by lengthening the coloring time to obtain a darker color, the throwing power of a bath is an intrinsic property of the selected coloring bath which cannot be altered by varying the voltage or the test duration. The corrosion properties of the plates obtained are not determined because no significant difference was to be expected between the Examples according to the invention and the Comparison Examples. In fact the corrosion properties overall are substantially the same.

TABLE 1

| Ex. | Throwing Power Improver | Conc., g/l | Visual Evaluation | Throwing Power | Observation |
|---|---|---|---|---|---|
| 1 | 5-Sulfosalicylic acid | 5 | Good | 89.8 | Lighter |
| 2 | | 10 | Good | 88.0 | Lighter |
| 3 | | 20 | Satisfactory | 94.7 | Lighter |
| 4 | 2-Naphthol-3,6-disulfonic acid, | 5 | Satisfactory | 85.6 | Lighter |
| 5 | Na salt | 10 | Satisfactory | 94.7 | Lighter |
| 6 | 2-Sulfobenzoic acid | 5 | Satisfactory | 79.4 | — |
| 7 | | 20 | Good | 87.0 | — |
| 8 | 2-Sulfobenzoic acid + 5-Sulfosalicylic acid | 2 + 10 | Good | 94.6 | — |
| Com. 1 | None | | Satisfactory | 74.4 | — |
| Com. 2 | Benzenehexacarboxylic acid | 5 | Unsatisfactory | * | Decolored |
| Com. 3 | Citric acid | 5 | Unsatisfactory | * | Decolored |
| Com. 4 | 1-napthol-2,3-disulfonic acid, Na salt | 5 | Satisfactory | 69.9 | |
| Com. 5 | Napthalenetrisulfonic acid, Na salt | 5 | Satisfactory | 75.3 | |
| Com. 6 | 2-Sulfoterephthalic acid, mono Na salt | 5 | Unsatisfactory | * | Decolored |
| Com. 7 | Sulfosuccinic acid | 5 | Unsatisfactory | * | Decolored |

*If the plate ends were very different, throwing power was not determined.

Electrolytic coloring

Test plates of the DIN material Al 99.5 (No. 3.0255) were conventionally pretreated (degreased, pickled, descaled) and anodized for 60 minutes by the DC process (200 g/l of sulfuric acid, 10 g/l Al(III), throughput of air, 1.5 A/dm$^2$, 18° C.). A layer approximately 20 μm thick was built up. The plates thus pretreated were then electrolytically colored with alternating current (50 Hz) as described in the following Examples. The following coloring baths were used:

Coloring bath I
10.0 g/l of Sn
20.0 g/l of sulfuric acid (96% by weight)
0.2 g/l of methyl hydroquinone
2.5 g/l of 5-sulfosalicylic acid
10.0 g/l of 4-sulfophthalic acid Coloring bath II
8.0 g/l of $CuSO_4 \cdot 5H_2O$
8.0 g/l of Sulfuric acid (96% by weight)
2.0 g/l of 2-sulfobenzoic acid
10.0 g/l of 5-sulfosalicylic acid Coloring bath III (Comparison)
6.0 g/l of Sn
4.0 g/l of $CuSO_4 \cdot 5H_2O$
10.0 g/l of sulfuric acid (96% by weight)
0.2 g/l of methyl hydroquinone
5.0 g/l of 5-sulfosalicylic acid
10.0 g/l of 4-sulfophthalic acid Coloring bath IV
0.5 g/l of $Ag_2SO_4$
8.0 g/l of sulfuric acid (96% by weight)

Coloring bath V
0.1 g/l of $Ag_2SO_4$
8.0 g/l of sulfuric acid (96% by weight)

Coloring bath VI (Comparison)
0.5 g/l of $Ag_2SO_4$
8.0 g/l of $CuSO_4 \cdot 5H_2O$
8.0 g/l of sulfuric acid (96% by weight)
2.0 g/l of sulfobenzoic acid
10.0 g/l of 5-sulfosalicylic acid In the electrochemical coloring tests using alternating current described in detail in the following, the coloring baths mentioned above were combined in various sequences. Test plates of the DIN material Al 99.5 (No. 3.0255) were conventionally pretreated (degreased, pickled, descaled) and anodized for 60 minutes by the DC process (200 g/l of sulfuric acid, 10 g/l Al(III), throughput of air, 1.5 A/dm$^2$, 10° C.). A layer approximately 20 μm thick was built up. The plates thus pretreated were colored as described in Table 2. The test plate was briefly rinsed with water between the first and second coloring steps. However, this process step is not absolutely essential where the coloring process is carried out on an industrial scale and was only introduced here to enable further tests to be carried out with the same baths under the same conditions.

Table 2 below shows the time sequence in which the coloring baths are used.

It can be seen from Table 3 below that extremely good corrosion protection values can be obtained with the Examples according to the invention. The corrosion behavior of the treated plates was investigated in the salt spray test according to DIN 50021. In the case of the Examples according to the invention, the test was generally terminated after 1000 h because there were no visible signs of corrosion. In a xenon test, it was found that there was no difference between the Examples and Comparison Examples in regard to the light stability of the color finish. In addition, the intensity of the color finish was visually evaluated in some Examples. Depth throwing was judged good to adequate in every case without significant differences occurring. In contrast to Comparison Examples 9 and 10, there was found to be a distinct improvement in corrosion behavior in the case of Examples 9 to 16 according to the invention.

TABLE 2

| Example | First Coloring Bath | Second Coloring Bath |
|---|---|---|
| 9 | I | II |
| 10 | I | II |
| 11 | I | II |

TABLE 2-continued

| Example | First Coloring Bath | Second Coloring Bath |
|---|---|---|
| 12 | I | II |
| 13 | I | II |
| 14 | I | II |
| 15 | II | I |
| 16 | II | I |
| 17 | II | IV |
| 18 | II | IV |
| 19 | II | IV |
| 20 | IV | II |
| 21 | IV | II |
| 22 | V | II |
| 23 | II | V |
| Com. 8 | III | — |
| Com. 9 | III | — |
| Com. 10 | VI | — |
| Com. 11 | VI | — |

TABLE 3

| | First Coloring Bath | | Second Coloring Bath | | | |
|---|---|---|---|---|---|---|
| Example | Duration, Min. | Voltage | Duration, Min. | Voltage | Corrosion | Color |
| 9 | 0.5 | 11 | 5.0 | 17.5 | >1000 | Light |
| 10 | 3.0 | 15 | 3.0 | 17.5 | 1000 | Dark |
| 11 | 5.0 | 15 | 1.0 | 17.5 | 1000 | Dark |
| 12 | 0.5 | 11 | 1.0 | 17.5 | >1000 | Light |
| 13 | 0.5 | 11 | 0.5 | 17.5 | >1000 | Light |
| 14 | 0.5 | 15 | 1.0 | 12.0 | 1000 | Light |
| 15 | 10 | 17.5 | 1.0 | 11.0 | >1000 | Medium |
| 16 | 2 | 20 | 0.5 | 11.0 | >1000 | Medium |
| 17 | 0.5 | 17.5 | 1.0 | 12.0 | >1000 | |
| 18 | 1.0 | 17.5 | 1.0 | 10.0 | >1000 | |
| 19 | 1.5 | 17.5 | 1.0 | 10.0 | >1000 | |
| 20 | 1.0 | 12 | 0.5 | 17.5 | >1000 | |
| 21 | 1.5 | 12 | 2.0 | 11.0 | >1000 | |
| 22 | 1.0 | 15 | 2.0 | 11.0 | >1000 | |
| 23 | 0.5 | 17.5 | 1.0 | 12.0 | >1000 | |
| Com. 8 | 3 | 15 | — | — | 600 | Medium |
| Com. 9 | 5 | 15 | — | — | 500 | Dark |
| Com. 10 | 4 | 15 | — | — | 350 | — |
| Com. 11 | 3 | 12 | — | — | 450 | — |

We claim:

1. A process for the electrolytic alternating-current coloring of anodized aluminum surfaces, said process comprising steps of:

(A) providing an acidic coloring bath A that is substantially free from tin(II) ions and silver ions but contains copper(II) ions and an electrolyte additive A' selected from the group consisting of (A'.a) benzene sulfonates corresponding to general formula (I):

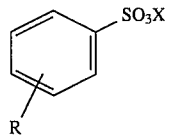

(I)

in which

R stands for one or more position-isomeric moieties, each of which is hydrogen, hydroxyl, carboxyl or aldehyde, with the proviso that not more than one is a carboxylic group (COOX), and X represents hydrogen or sodium or potassium cation, and (A'.b) naphthalene disulfonates corresponding to general formula (II):

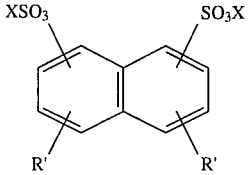

(II)

in which

R' stands for one or more position-isomeric moieties, each of which is hydrogen, hydroxyl, carboxyl or aldehyde, with the proviso that no hydroxy group is present in the 1-position of the naphthalene ring, and X is as defined above;

(B) providing an acidic coloring bath B that is substantially free from copper(II) ions but contains (B.1) tin(II) ions, silver ions, or both tin(II) and silver ions; and, if bath B contains tin(II) ions, also contains (B.2) an electrolyte additive B' containing:

(B'.1) at least one stabilizer for tin(II) ions, said at least one stabilizer corresponding to one of the general formulas (III) to (VII):

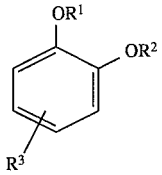

(III)

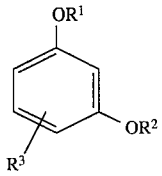

(IV)

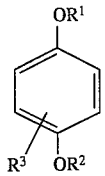

(V)

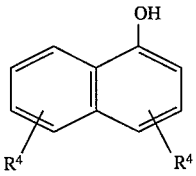

(VI)

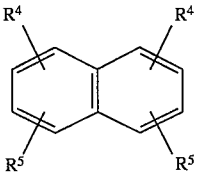

(VII)

in which $R^1$ and $R^2$ represent hydrogen, alkyl, aryl, alkylaryl, alkylaryl sulfonic acid, alkyl sulfonic acid and alkali metal salts thereof containing 1 to 22 carbon atoms, $R^3$ represents one or more hydrogen and/or alkyl, aryl, alkylaryl moieties containing 1 to 22 carbon atoms, $R^4$ represents one or more sulfonic acid groups ($SO_3X$), $R^5$ represents one or more hydrogen and/or alkyl, aryl and alkylaryl moieties containing 1 to 22 carbon atoms and X is as defined above, at least one of the substituents $R^1$, $R^2$ and $R^3$ not being hydrogen; and (B'.2) at least one throw improver corresponding to one of the general formulae (VIII) and (IX):

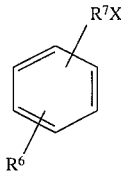

(VIII)

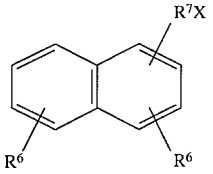

(IX)

in which $R^6$ stands for one or more position-isomeric moieties, each of which is hydrogen, hydroxyl, carboxyl, aldehyde or $C_{1-6}$ alkyl, $R^7$ represents one or more carboxyl groups (COO) or sulfonic acid groups ($SO_3X$) and X is hydrogen or an alkali metal cation selected from sodium and potassium; and (C) either (C.1 ) coloring the aluminum surfaces by alternating current electrolysis in first bath (A) and subsequently in bath (B) or (C.2) coloring the aluminum surfaces by alternating current electrolysis first in bath (B) and subsequently in bath (A).

2. A process as claimed in claim 1, wherein coloring bath A contains from 1 to 2 g/l of copper(II) ions.

3. A process as claimed in claim 2, wherein copper(II) ions are introduced into coloring bath A in the form of copper(II) sulfate.

4. A process as claimed in claim 3, wherein the electrolyte additive A' is selected from the group consisting of 2-sulfobenzoic acid, sulfosalicylic acid, 2-naphthol-3,6-disulfonic acid, the sodium and potassium salts of all of these acids, and mixtures of any one or more of these acids and salts.

5. A process as claimed in claim 4, wherein the electrolyte additive A' is used in the quantity of 5 to 20 g/l, based on coloring bath A.

6. A process as claimed in claim 5, wherein coloring bath A contains sulfuric acid in a quantity of 2 to 25 g/l.

7. A process as claimed in claim 6, wherein coloring bath A is operated at a pH value of 0.5 to 2, at a temperature of 10° to 30° C., at an a.c. voltage frequency of 50 to 60 Hz and at a terminal voltage of 10 to 25 V.

8. A process as claimed in claim 1, wherein coloring bath B contains from 7 to 16 g/l of tin(II) ions.

9. A process as claimed in claim 8, wherein the stabilizer for tin(II) ions is selected from the group consisting of tert-butyl hydroquinone, methyl hydroquinone, trimethyl hydroquinone, 4-hydroxy-2,7-naphthalene disulfonic acid, naphthalene-1,5-disulfonic acid and p-hydroxyanisole.

10. A process as claimed in claim 9, wherein the stabilizers for tin(II) compounds are used in a quantity of 0.01 to 2 g/l, based on coloring bath B.

11. A process as claimed in claim 10, wherein the throw improvers in the electrolyte additive B' are selected from the group consisting of 5-sulfosalicylic acid, 4-sulfophthalic acid, 2-sulfobenzoic acid, benzoic acid, sulfoterephthalic acid, naphthalene trisulfonic acid, 1-naphthol-2,3-sulfonic acid, naphthalene sulfonic acid, p-toluene sulfonic acid, benzene hexacarboxylic acid, the sodium and potassium salts of all these acids, and mixtures of any one or more of these acids and salts.

12. A process as claimed in claim 11, wherein the throw improvers are used in a quantity of 0.1 to 30 g/l, based on coloring bath B.

13. A process as claimed in claim 1, wherein coloring bath B contains from 0.3 to 1.2 g/l of silver ions.

14. A process as claimed in claim 13, wherein coloring bath B contains p-toluene sulfonic acid; water-soluble alkali metal, ammonium, or alkaline earth metal salts thereof; or mixtures of any one or more thereof in a quantity of 5 to 25 g/l of electrolyte solution B.

15. A process as claimed in claim 14, wherein coloring bath B contains sulfuric acid in a quantity of 5 to 30 g/l.

16. A process as claimed in claim 15, wherein coloring bath B is operated at a pH value of 0.1 to 2, at a temperature of 10° to 30° C., at an a.c. voltage frequency of 50 to 60 Hz and at a terminal voltage of 8 to 18 V.

17. A process as claimed in claim 1, wherein the electrolyte additive A' is selected from the group consisting of 2-sulfobenzoic acid, sulfosalicylic acid, 2-naphthol-3,6-disulfonic acid, the sodium and potassium salts of all of these acids, and mixtures of any one or more of these acids and salts.

18. A process as claimed in claim 1, wherein the electrolyte additive A' is used in the quantity of 2 to 30 g/l, based on coloring bath A.

19. A process as claimed in claim 1, wherein coloring bath A is operated at a pH value of 0.5 to 2, at a temperature of 10° to 30° C., at an a.c. voltage frequency of 50 to 60 Hz and at a terminal voltage of 10 to 25 V.

20. A process as claimed in claim 1, wherein coloring bath B is operated at a pH value of 0.1 to 2, at a temperature of 10° to 30° C., at an a.c. voltage frequency of 50 to 60 Hz and at a terminal voltage of 4 to 25 V.

* * * * *